US006637166B2

(12) United States Patent
Kinsey

(10) Patent No.: US 6,637,166 B2
(45) Date of Patent: Oct. 28, 2003

(54) INTEGRATED COMMUNICATIONS AND CONNECTION SYSTEM FOR TRUCK TRACTORS

(75) Inventor: Gregory W. Kinsey, Culver City, CA (US)

(73) Assignee: R. A. Phillips Industries, Inc., Santa Fe Springs, CA (US)

( * ) Notice: Subject to any disclaimer, the term of this patent is extended or adjusted under 35 U.S.C. 154(b) by 151 days.

(21) Appl. No.: 09/757,936

(22) Filed: Jan. 10, 2001

(65) Prior Publication Data

US 2002/0016086 A1 Feb. 7, 2002

Related U.S. Application Data

(60) Provisional application No. 60/175,938, filed on Jan. 13, 2000, and provisional application No. 60/181,407, filed on Feb. 9, 2000.

(51) Int. Cl.[7] ..... E04C 2/52

(52) U.S. Cl. ..... 52/220.8; 174/67; 174/68.2; 174/71 B; 174/99; 220/3.8; 220/242; 439/119; 439/147; 439/212

(58) Field of Search ..... 52/220.1, 220.8; 174/66, 67, 99, 68.2, 71 B; 220/241, 242, 3.8; 439/135, 147, 119, 212

(56) References Cited

U.S. PATENT DOCUMENTS 5,362,924 A * 11/1994 Correnti ..... 174/67
5,763,831 A * 6/1998 Shotey et al. ..... 174/67
5,998,735 A * 12/1999 Patterson, Jr. ..... 174/67
6,028,268 A * 2/2000 Stark et al. ..... 174/67
6,046,405 A * 4/2000 Obermann ..... 174/57
6,184,468 B1 * 2/2001 Speziale ..... 174/66
6,399,882 B1 * 6/2002 Faulkner et al. ..... 174/99 B
6,420,654 B1 * 7/2002 Shotey et al. ..... 174/66

* cited by examiner

*Primary Examiner*—Carl D. Friedman
*Assistant Examiner*—Yvonne M. Horton
(74) *Attorney, Agent, or Firm*—Christie, Parker & Hale, LLP

(57) ABSTRACT

To enable vehicles such as truck tractors, motor homes and recreational vehicles to receive electrical power and communications when parked, a power and communications assembly is provided. A base is mountable in an exterior surface of the vehicle openings through the base are defined for mounting a respective connection moiety so each mounted moiety can be engaged with a complementary connection moiety when a main cover for the base and the mounted moieties is opened against a bias causing it to be normally closed. The connection moieties mountable in the base openings are selected from a group which includes electrical power connectors, telephone circuit connectors, and connectors for coaxial cables and fiber optic cables. Features of either a base opening or a mounted connection moiety can be engaged by its own secondary cover; the several secondary covers when engaged can be accommodated with a space protected by the main cover when it is closed.

12 Claims, 10 Drawing Sheets

FIG. 5
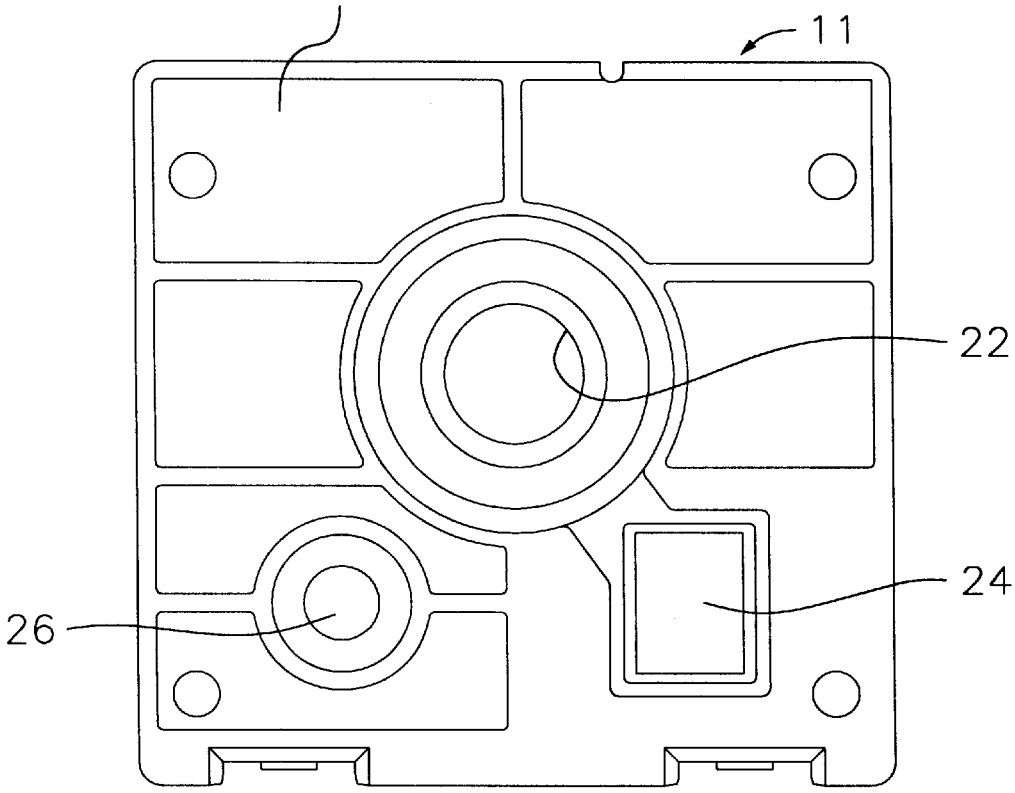
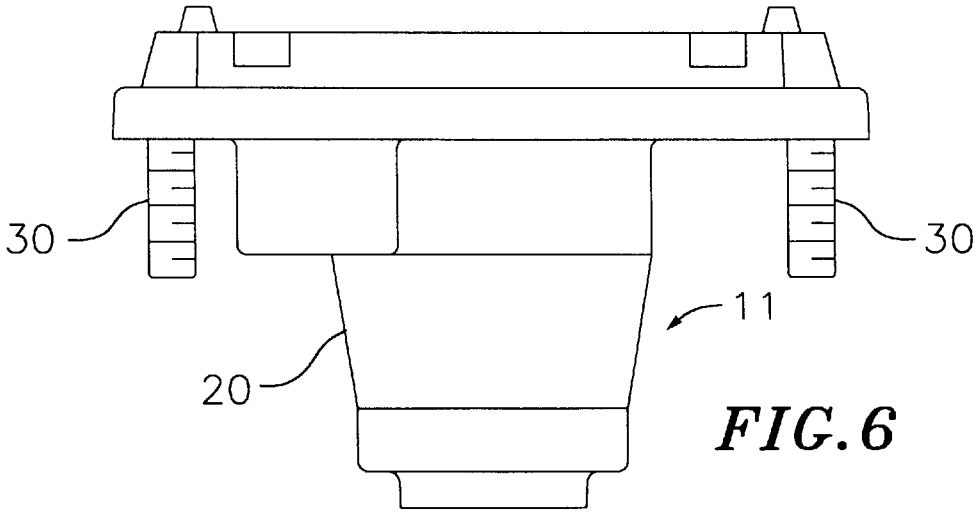
FIG. 6

INTEGRATED COMMUNICATIONS AND CONNECTION SYSTEM FOR TRUCK TRACTORS

CROSS-REFERENCE TO PRIOR APPLICATIONS

This application claims the priority of U.S. Provisional applications No. 60/175,938, filed Jan. 13, 2000 and No. 60/181,407, filed Feb. 9, 2000. The contents of those applications are incorporated hereinto by reference.

FIELD OF THE INVENTION

This invention pertains to electrical signal and power connections to heavy duty truck tractors. More particularly, it pertains to an integrated arrangement for making power, telephone, cable television and other electrical signal connections to such tractors which include driver sleeping accommodations.

BACKGROUND

Heavy duty truck tractors are increasingly equipped with driver sleeping accommodations in the rear portions of the cabs of the tractors. Such accommodation units are commonly known as "sleeper boxes." Some sleeper boxes are comparatively spacious. A sleeper box serves as a home on the road for the tractor driver. Operators of large fleets of heavy duty truck tractors and trailers are increasingly equipping their tractors with sleeper boxes in an effort to reduce high turnover rates of employed drivers. Fleet operators and others are equipping the sleeper boxes with such amenities as television sets and telephones, as well as AC power capacity. The objective is to enable a driver to do more than sleep in the tractor during times when the truck rig is overnighting at a truck stop or the like.

In parallel with the trend described above, operators of truck stops have begun to make electrical power, cable television, and telephone connections available in the areas of truck stops where drivers park their rigs (tractor and trailer sets). In cold climates, electrical power for operating engine block heaters in truck diesel engines also is made available by truck stops. Those electrical functions are provided at posts distributed throughout the parking area. A driver desiring to make use of those functions can plug suitable conductors, e.g., extension cords, from the trailer to the function outlets on the post. Each such extension cord currently has its own separately mounted connection to the tractor, either to a corresponding connection site accessible at the exterior of the tractor or to a desired place within the tractor. In the latter situation, the extension cords may enter the tractor through a partially open window in a door to the tractor. Each separate connection site in the exterior of the tractor is associated with a separate hole in the tractor surface, and with separate wiring in the tractor to outlets in the tractor, notably in the sleeper box.

Currently, the procedures and the equipment used to provide such convenience connections to and within truck tractors and their sleeper boxes have been developed and exist on an ad hoc basis. A need exists for arrangements which enable a tractor manufacturer or a tractor owner to provide electrical power and signal convenience functions within a tractor more efficiently.

SUMMARY OF THE INVENTION

This invention addresses the need noted above by providing an integrated multi-function junction box which is mountable at a single location in the exterior wall of a tractor, more preferably in the exterior wall of a sleeper box which is a component of the tractor. The junction box has a self-closing gasketed access door. The door is openable relative to the box to afford access to a preferably grounded alternating current receptacle, to a telephone jack, to a coaxial cable connector, and to such additional power or signal connectors as may be desired. The receptacle, the jack and the connectors can be components of a wiring harness which, when the junction box is suitably mounted to be accessible at the exterior of the tractor sleeper box, enables the junction box connection moieties to be connected to appropriate outlets or terminals within the sleeper box or elsewhere in the tractor.

In the manufacture of heavy duty truck tractors, it is common to fabricate sleeper boxes as modules which can be mounted to the tractor chassis immediately to the rear of the tractor cab. Sleeper boxes can be made in a range of sizes. Other sleeper compartments are made integral with the tractor cab. The junction box and wiring harness system provided by this invention simplifies and lowers the cost of manufacture of a sleeper box or tractor cab having the power and communication features and functions noted above. Also, the reliability of those functions is enhanced.

A computer in the tractor can be connected via the telephone connection or via the cable TV connection to the Internet or such other computer networks as may be desired.

In one of its embodiments, the invention provides a power and communication assembly for vehicles including truck tractors, motor homes, recreational vehicles and the like. The assembly includes a base which is adapted to be mounted to a vehicle exterior surface to present a front face of the base to the exterior of the vehicle and to present a rear face of the base inwardly of that surface. A plurality of openings are formed through the base inwardly of a perimeter of the base. Each opening is defined and configured for receiving and mounting a respective selected connection moiety for cooperation of that moiety, adjacent the base front face, with a complementary connection moiety. The connection moieties which are mountable in the base openings are selected from a group which includes electrical power connectors, telephone circuit connectors, coaxial cable connectors, fiber optic cable connectors, and connectors on cords from infrared wireless communications receivers. A cover is hinged to the base and is biased into a closure relation to the base in which the cover protects connection moieties mounted in the base openings.

DESCRIPTION OF THE DRAWINGS

Presently preferred and other embodiments of apparatus according to this invention are illustrated in the accompanying drawings, wherein:

FIG. 5 is a rear elevation view of that base component;

FIG. 6 is a bottom plan view of that base component;

DESCRIPTION OF THE ILLUSTRATED EMBODIMENTS OF THE INVENTION

As shown in the accompanying figures, a principal component of a first product 10 according to this invention is a base 11. The base preferably is of one-piece construction and preferably is molded. The preferred material of a molded base is ABS resin; glass-filled nylon also can be used. Other materials and fabrication processes can be used to define the base. For example, a base could be made of metal by a die casting process.

Figure 3:
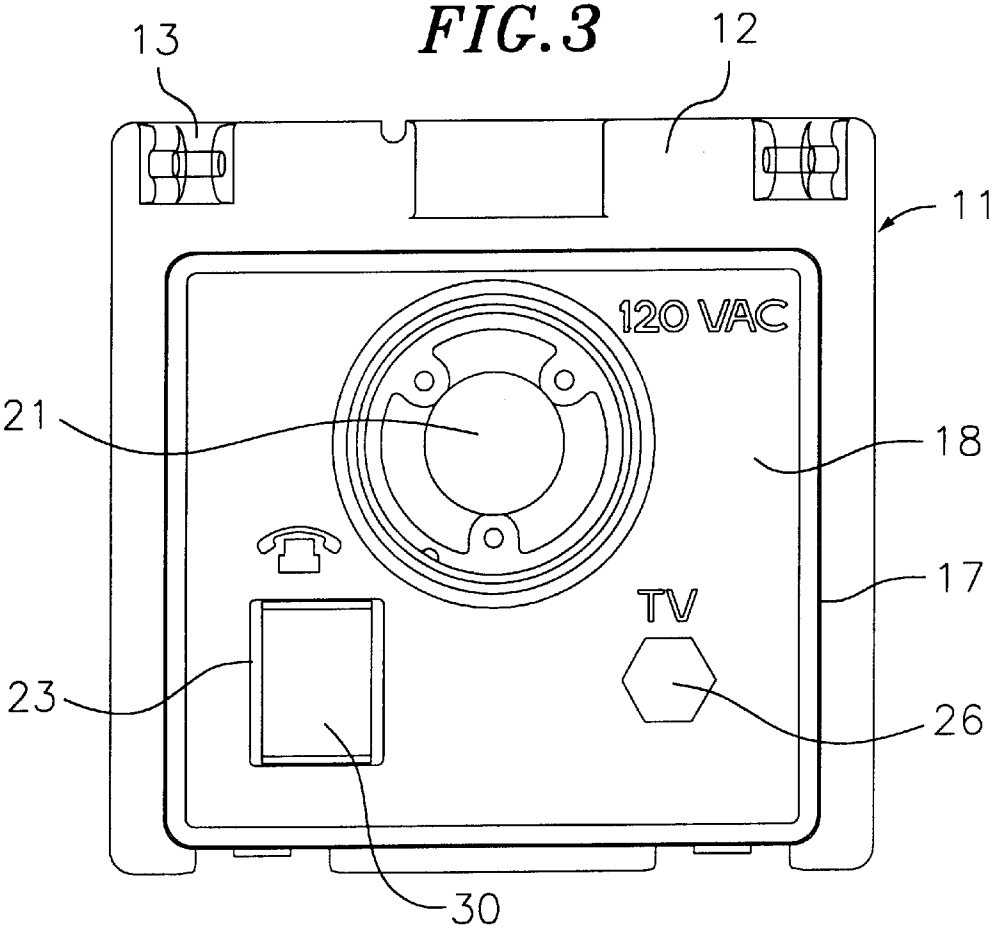
FIG. 3 is a front elevation view of that base component.
Figure 7:
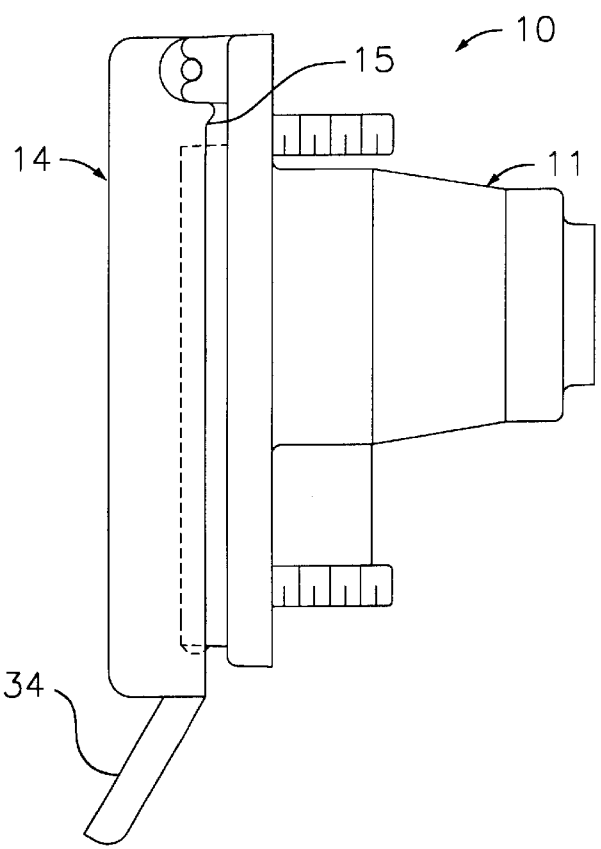
FIG. 7 is a side elevation view of the junction box base component as fitted with a spring loaded shallow door at the front of the base component.

As shown in FIGS. 3 and 5, the basic outline of base 11, when seen in front or rear elevation, can be square or rectangular, as defined by a substantially planar wall 12. In the upper corners on the front of the wall there can be projecting aligned lugs 13 for mounting a hinge axle pin (not shown) which can extend transversely of the wall and parallel to it. The hinge axle pin can support a pivotable door or cover 14 (see FIG. 7) via lugs 15 carried by the cover. A torsion spring can be mounted around the hinge axle pin and coupled between the door and the base in a stressed state which urges the door into the closed state relative to the base as shown in FIG. 7. A gasket (not shown) carried by the rear face of the door can mate with a sealing flange 17 raised from the front face of the base wall in a manner which forms a substantially square frame around the central and major area of the front face of wall 12. Flange 17 bounds a shallow chamber 18 at the front face of the base.

Base 11 can be configured to define a plurality of apertures or recesses in wall 12 in which can be mounted desired connection moieties. Thus, as preferred, in the upper central part of chamber 18, the base is configured to define a rearwardly extending structural sleeve 20 which is open at its opposite ends. The front opening 21 of the sleeve opens to chamber 18. A grounded (3 terminal) female 120 VAC electrical socket of conventional manufacture can be mounted securely in the sleeve to be accessible at its terminal end from the front face of wall 12. The connector moiety mounted in the sleeve will have three insulated conductors (wires) connected to it. Those conductors can pass through opening 22 at the rear of sleeve 20. If desired, and as may be preferred, a strain relief and water seal device, such as manufactured by Heyco, can be mounted to the exterior of sleeve 20 around opening 22 to protect those conductors and to assure that moisture cannot enter the interior of the sleeve from its rear end. A gasket can be used between the socket and the sleeve to seal the product from entry of moisture into the sleeve through opening 21.

Further, as preferred, the base 11, in a lower corner of chamber 18, defines an opening 24 in which can be mounted a female moiety of a telephone jack connection of known manufacture. The insulated conductors from the female jack can pass from the rear of wall 12. The phone jack mounting opening can be surrounded by its own frame 23, preferably rectangular in shape, which extends forwardly from wall 12 into chamber 18 and from the base rear face. Still further, as preferred, in the other lower corner of chamber 18 there can be defined an opening 26 in which can be mounted the female moiety of a coaxial cable connector of known manufacture, using conventional mounting hardware for that purpose. The coaxial connector structure mounted in opening 26 can be a female/female coupling.

The accompanying figures also show that, as preferred, a plurality of externally threaded mounting studs 30 can extend from the rear face of wall 12, preferably one in each corner of the wall. The studs can be metal and can be incorporated into base 11 when, as preferred, the base is formed by an injection molding or casting process. Those studs can cooperate in suitable holes formed in an exterior wall of a tractor sleeper cab, or elsewhere on the tractor as appropriate, and with nuts and lockwashers, e.g., for securing the product to the tractor. The holes in which studs 30 cooperate for mounting the product preferably are adjacent to a single, suitably shaped larger hole in the sleeper box or tractor wall, which single hole is sized to accommodate base sleeve 20 and also such connector structures as project rearwardly from holes 24 and 26. A suitably apertured gasket can be used between the rear of wall 12 and the surface to which the base is mounted to provide a suitable weather seal.

The insulated conductors which extend rearwardly from the connection moieties mounted in base 11 can be part of, or connected to, a wiring harness for the sleeper box of interest. The connectors from the AC connector in product 10 can be connected to an inverter which can output 12 VDC and/or 120 VAC electrical power.

The presently preferred mounting site for product 10 in a tractor is in a side wall of the sleeper box on the driver side of the tractor. Another workable mounting site can be on a fairing for the fuel tank of the tractor. That tank commonly is located on the driver side of the tractor.

Cover 14 shown in FIG. 7 is substantially planar. It preferably has a recess in its rear face into which base flange 17 can extend when the cover is closed against base 11. It will be apparent that when one or more extension cords are connected to connection moieties carried in base 11, the cover is prevented by them from moving to its fully closed state. A tab 34 can be extended from the bottom edge of cover 14 to afford easy opening of the cover.

Figure 8:
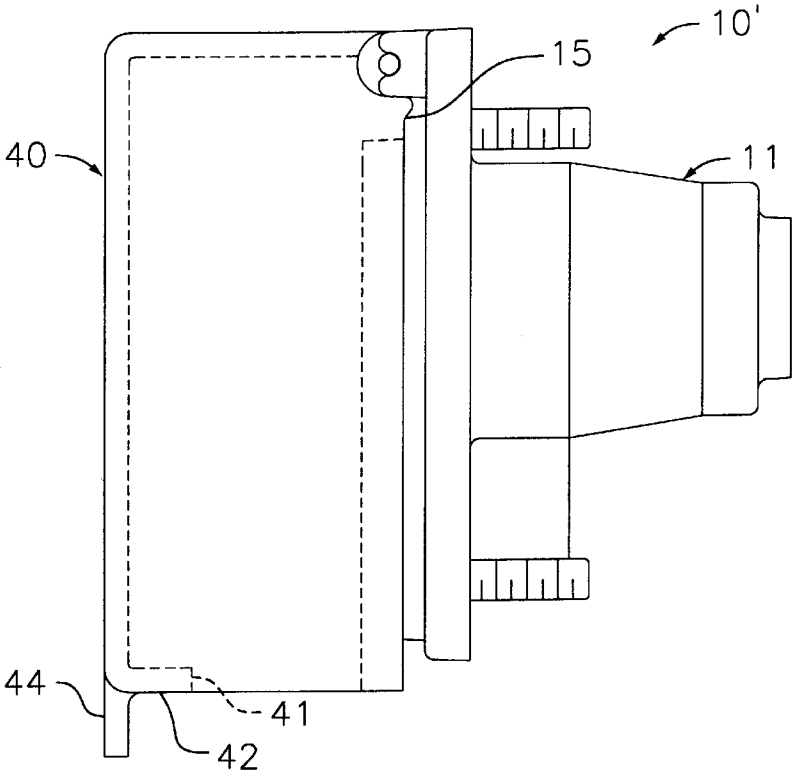
FIG. 8 is a side elevation view of the junction box component as fitted with a deep, internally chambered door at the front of the base component.

FIG. 8 shows a product 10' which is in accord with the foregoing descriptions except as to its cover 40. Cover 40 is significantly and substantially cubical in configuration. It is hollow and is closed except for the absence of a full rear wall and except for an opening 41 in a bottom wall 42 of the cover. Opening 41 can occupy a major fraction of the bottom of the cover. Opening 41 provides an access port into a chamber defined within the cover. That chamber and opening 41 can be sized to enable the cover to be in its closed state relative to base 11 even when AC power, telephone, and coaxial cable extension cords are plugged into the connectors carried by the base. The extension cords can pass through cover opening 41. Cover 40 can have a finger tab 44 to make opening the cover easier.

A second and presently more preferred communication and power connection junction box 35 according to this invention is shown in FIGS. 9–12. Components of that product are shown in FIGS. 12–23. In view of the foregoing descriptions and the content of FIGS. 1–8, it will be apparent that box 35 has many features in common with box 10, and so reference numbers used in FIGS. 1–7 are used where appropriate in FIGS. 9–23.

Figure 10:
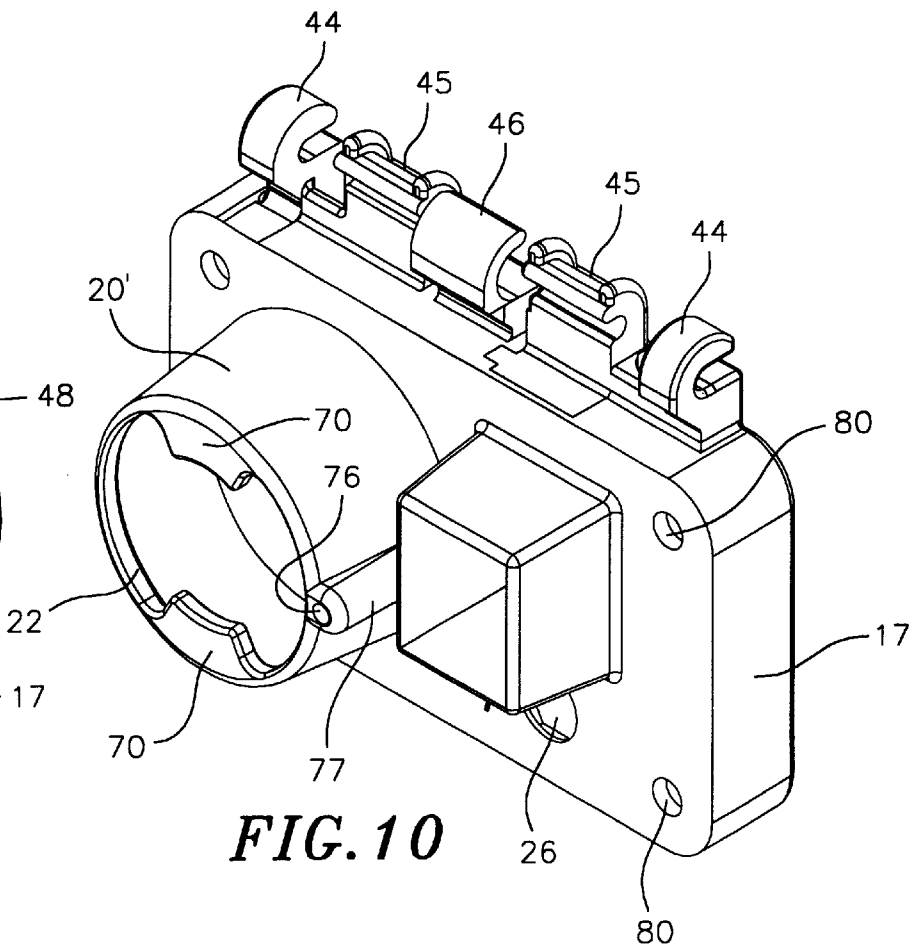
FIG. 10 is a rear perspective view of that base component.
Figure 9:
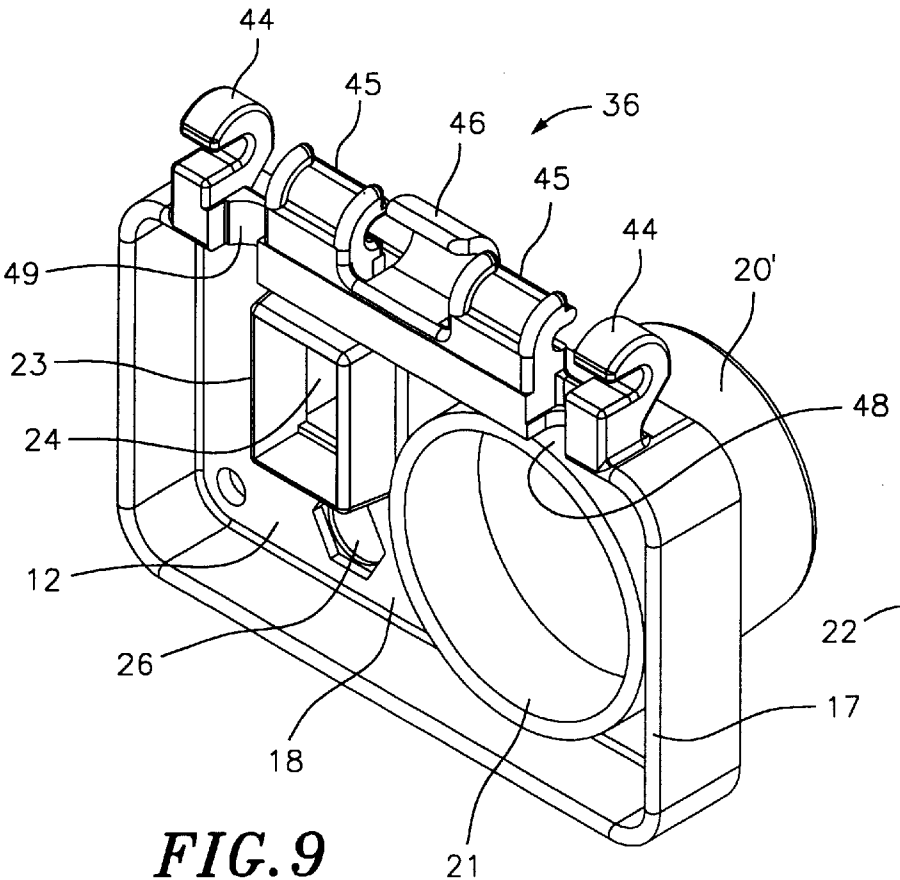
FIG. 9 is a front perspective view of the base component of a second integrated junction box.
Figure 12:
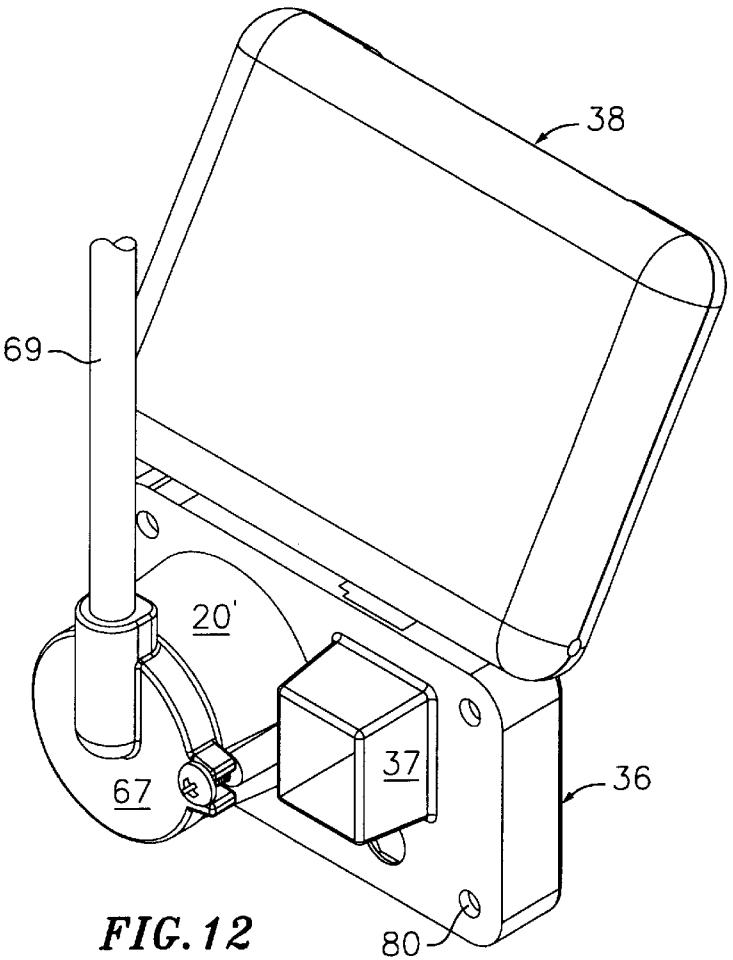
FIG. 12 is a rear perspective view of the junction box shown in FIG. 11.
Figure 23:
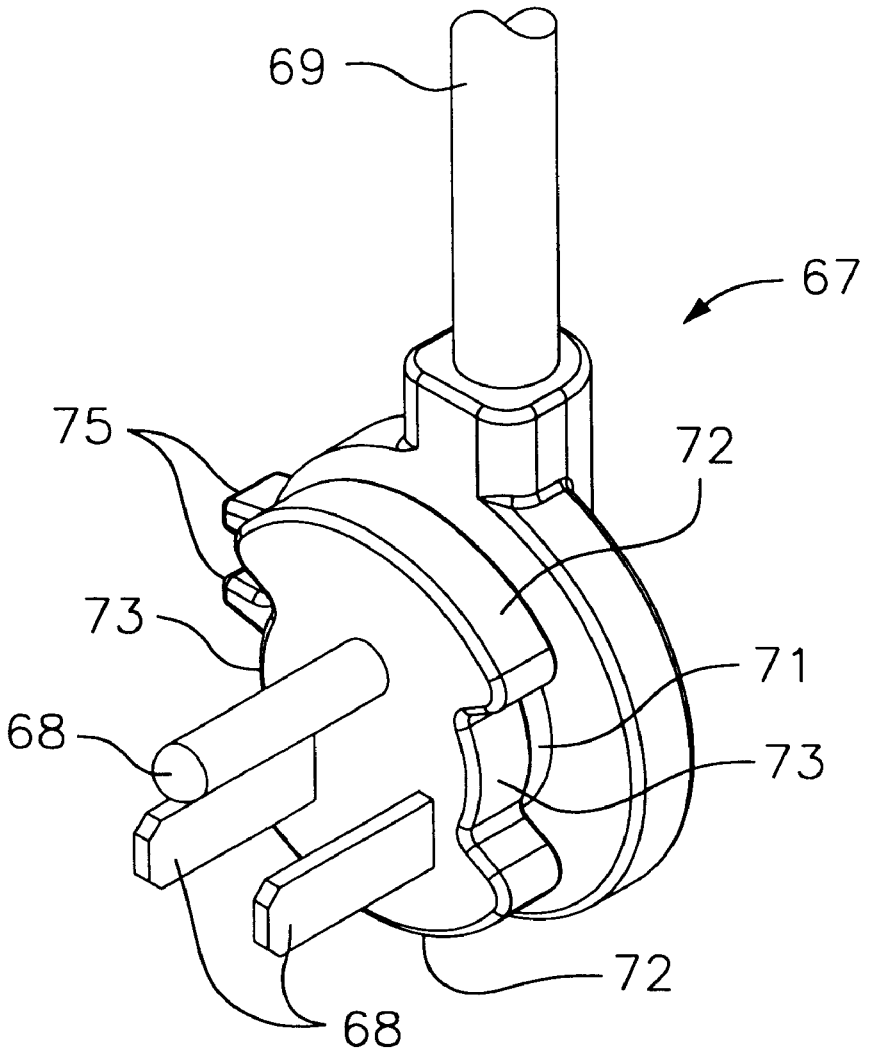
FIG. 23 is a perspective view of an electric power connection moiety which is specially adapted for coupling to the component shown in FIG. 10.

Whereas box 10 is generally square when viewed in a front or rear elevation, box 35 is rectangular and preferably is wider than it is high. As shown in FIGS. 9 and 10, the sleeve-like receptacle 20' for an electrical power connection moiety (preferably a male moiety as shown in FIG. 23) is at one end of the chamber 18 enclosed by front frame 17 of base 36. At the other end of that chamber are located aperture 24 for a telephone jack and aperture 26 for a coaxial cable connection moiety such as the female/female coupling mentioned above. A frame 23 surrounds aperture 24. A deeper frame 37 around aperture 24 can extend from the rear face of base 36 as shown in FIGS. 10 and 12. The phone jack mounting opening 24 preferably is located above the cable connection mounting opening 26.

Figure 11:
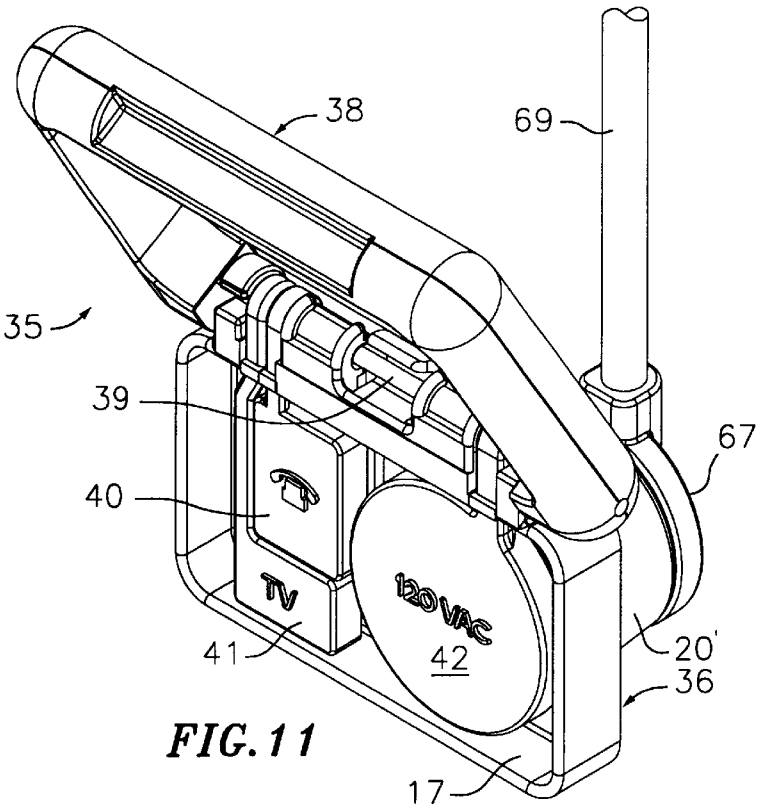
FIG. 11 is a front perspective view of a second integrated connection junction box according to this invention with its outer cover in an open position.
Figure 14:
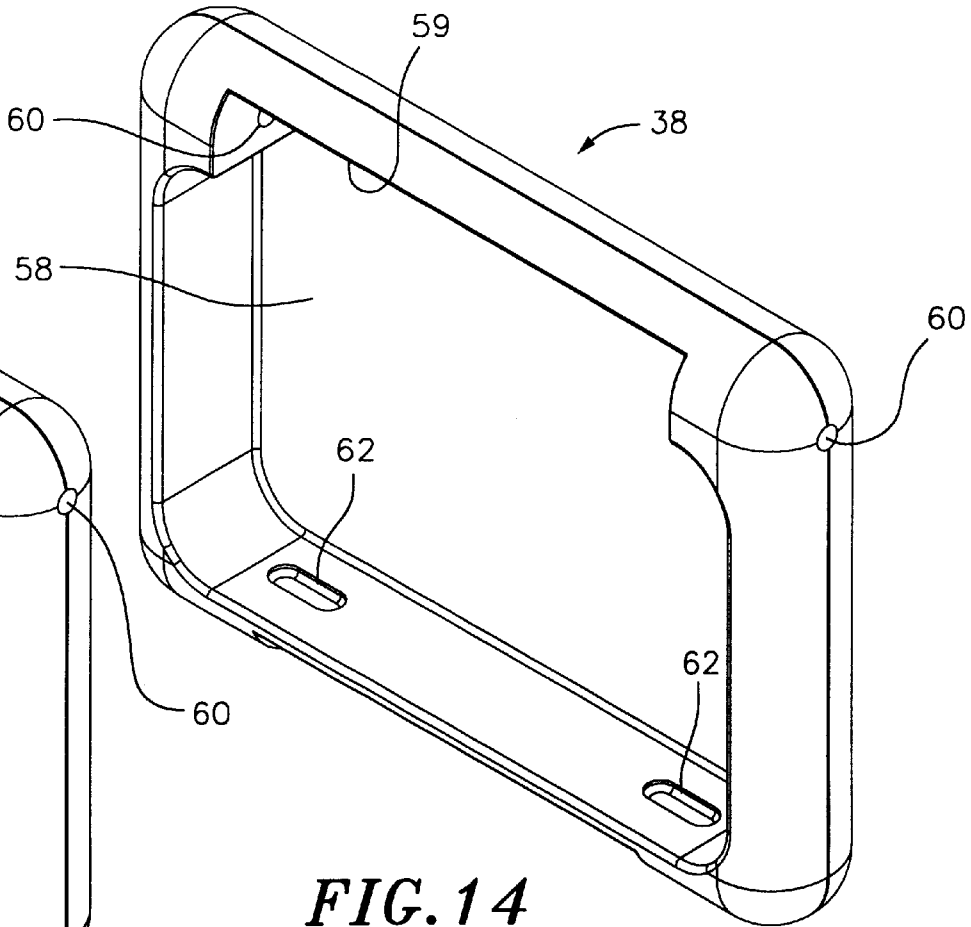
FIG. 14 is a rear perspective view of that door.
Figure 13:
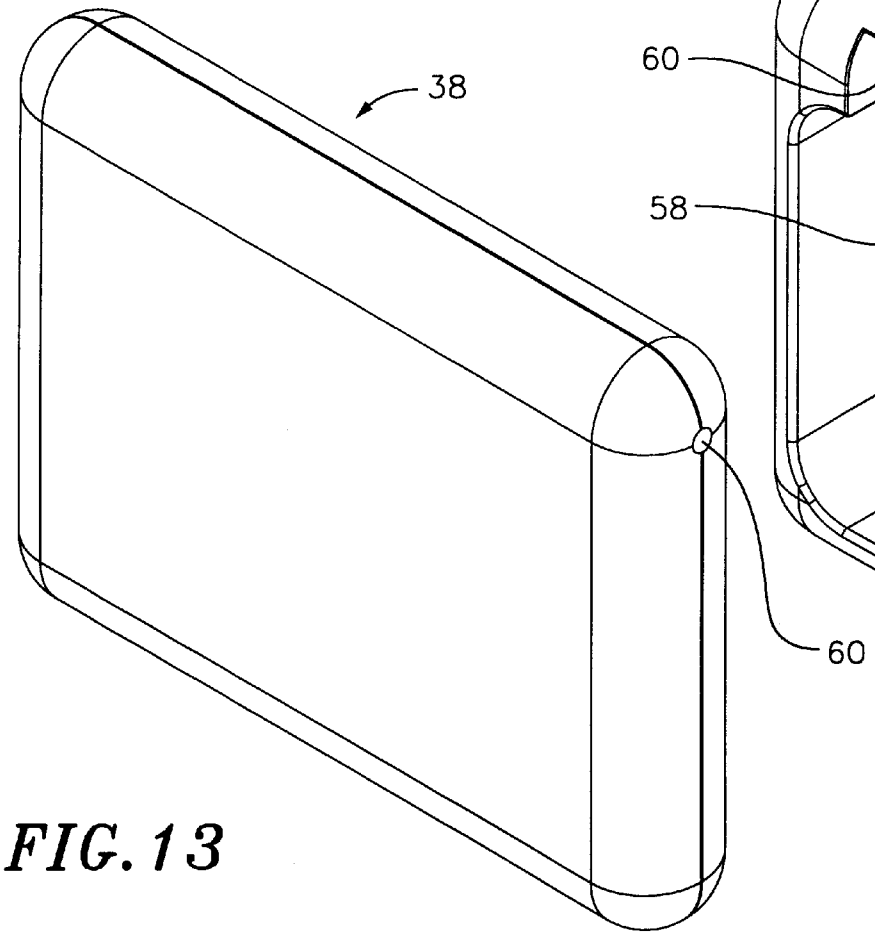
FIG. 13 is a front perspective view of the door for the junction box shown in FIGS. 11 and 12.

The overall box 35 has a main closure door 38 which is hinged to the top of base 36 and is biased into its closed position around base framing flange 17 by a spring which is engaged between the door and the base, preferably in association with the hinge pin 39, in a manner which hides the spring when the door is closed. The spring is not shown but surrounds the hinge pin at the location of the end of the lead line from numeral 39 in FIG. 11. The door and the base are coupled together by a hinge pin 39 which is carried in the door and also is not readily visible. Also, each connection moiety mounted in base 36 has its own secondary cover, namely, phone jack cover 40, coaxial connection cover 41 and electrical power connection cover 42, each of which has its own hinge connection to hinge pin 39, as shown in FIG. 11, e.g. If desired, the covers for the phone jack and the coaxial connector can be combined (made common to each other) on a single hinge arm. The base 36 and door 38 of box 35 preferably are defined by injection molded ABS resin or glass-filled nylon which is relatively hard and rigid. Connection covers 40–42 can also be made of a hard material, preferably by injection molding. More preferably, however, covers 40–42 are defined by a softer and more deformable material so that, when in their closed positions, they sealingly conform to and snugly fit around either the structural frame around their respective connection moiety in the case of covers 40 and 42 or to the connection moiety itself as can be the case with cover 41.

As shown best in FIGS. 9 and 10, two pairs of upstanding lugs 44 and 45 on the top of base 35 cooperate with hinge pin 39 to mount door 38 to base 36. Those lugs are arranged symmetrically on either side of a central cage 46 for a torsion spring (not shown) which is disposed about hinge pin 39 and which has opposite ends engaged with base 36 and with door 38 respectively.

As can be seen best in FIG. 9, a forwardly facing notch-like opening 48 is formed through the top portion of base frame flange 17 between lugs 44 and 45 which are located generally above sleeve 20'. A similar opening 49 is formed through flange 17 between the others of lugs 44 and 45 adjacent to the location of connection mounting openings 24 and 26. Notch 48 accommodates a hinge arm 50 of the electrical power connection cover 42 (see FIG. 22) which terminates in a pad 51 having a hole 52 through it for cooperation of the pad around hinge pin 39. A projection 53 extends transversely across the front face of arm 50 at a location on the arm which causes the projection to appear as a continuation of flange 17 when cover 50 is engaged around the front end of sleeve 20'. The cross-sectional configuration of arm 50 at the location of projection 53 is such that the arm fits snugly into notch 48 and is squeezed by the closed door 38 into sealing contact with the walls of the notch and with the door.

Similarly, phone jack cover 40 has a hinge arm 55 connected to it. The arm terminates in a pad 51 having a hole 52 through it and carries a projection 53 as described concerning hinge arm 50 for cover 42. Also, coaxial cable connection cover 41 has a hinge arm 56 with a pad, a hole and a projection as so described. The width of hinge arms 55 and 56 together, and their cross-sectional configurations at projections 53 taken together, are defined so that when both covers are in their closed positions as shown in FIG. 9, those arms are parallel and fill notch 49 to be squeezed snugly between the base and the door when the door is closed. That snug engagement of the cover arms in notch 49 seals the notch so that water, e.g., cannot enter chamber 18 via the notch. The pads 51 of arms 55 and 56 are engaged about door hinge pin 39 between lugs 44 and 45 above openings 24 and 26. As shown in FIG. 9, cover arm 56 can be configured to extend alongside and past cover 40 to its cover 41. As noted above, covers 40 and 41 can be separate or common to each other.

Connection covers 40, 41 and 42 have recessed rear surfaces. The shape and size of each recess is defined to cooperate closely with frame 23, a coaxial cable connector, and the front end of sleeve 20', respectively, to provide further seals for the respective connectors.

Figure 2:
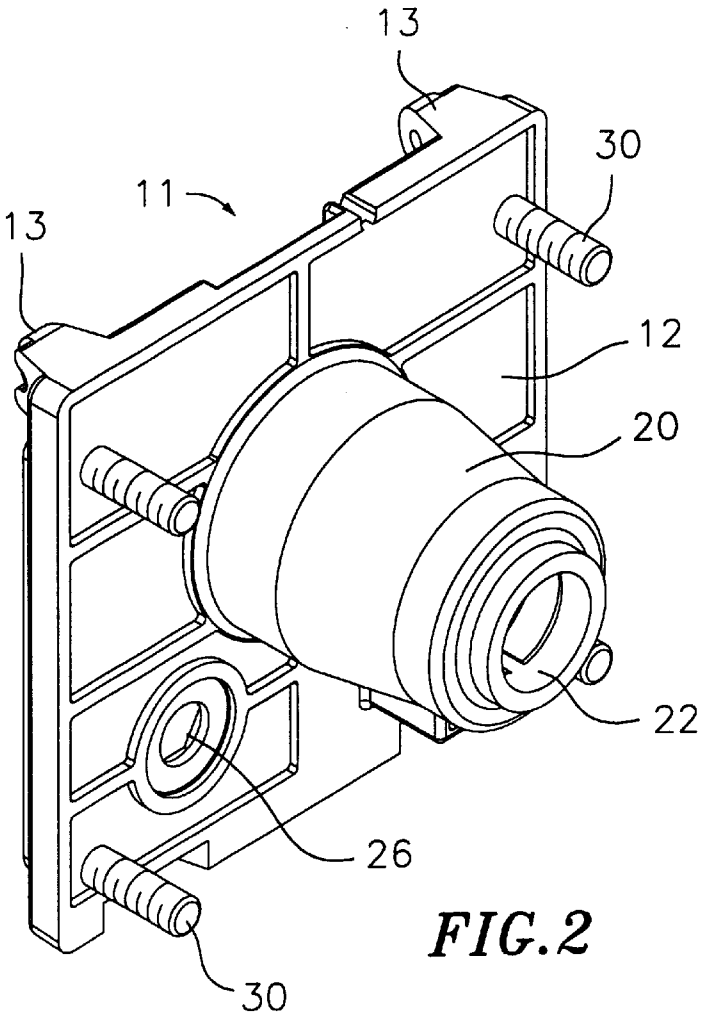
FIG. 2 is a rear perspective view of the junction box base component shown in FIG. 1.
Figure 1:
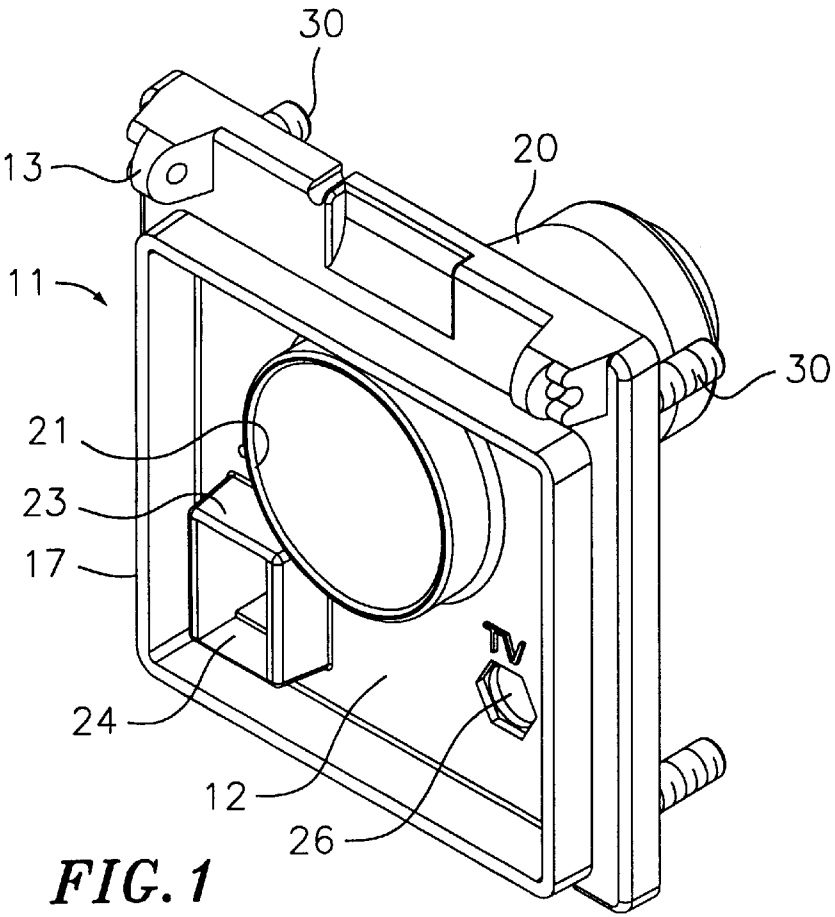
FIG. 1 is a front perspective view of the base component of a first integrated junction box according to this invention.
Figure 4:
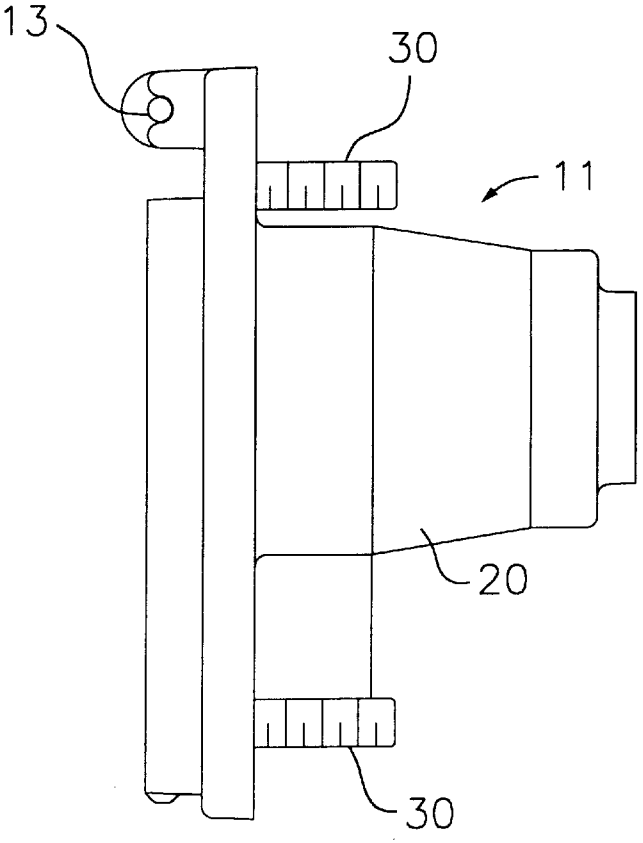
FIG. 4 is a right side elevation view of that base component.

Door 38 for junction box 35 is shown in FIGS. 13–16. When in its closed relation to base 36, the door preferably completely surrounds and receives base front flange 17 within a recess 58 defined in a rear surface of the door. The base of the recess can carry a gasket pad, such as a pad 80 of soft resiliently deformable closed-cell foam material, for sealing contact with the forward edge of base flange 17 and for bearing against connection covers 40–42 when the door is closed. Recess 58 has an extension 59 partially along its top edge for enclosing lugs 44 and 45 and spring cage 46 when the door is closed. Hinge pin 39 is carried in aligned holes 60 defined in the door at opposite ends of recess extension 59. A pair of shallow small depressions or recesses 62 can be provided in the bottom wall of recess 58, near respective ends of the door, for snap-fit releasable cooperation with corresponding detent bumps defined on the bottom exterior surface of base flange 17. Similar detent bumps base 11 are shown in FIGS. 3, 4 and 5. Depressions 62 and bumps 63 cooperate to provide a latch effect which releasably holds door 38 in closed relation to the base. A finger ledge 64 preferably is defined along the bottom of the door between its ends (see FIGS. 16 and 17) to enable the door to be pulled easily out of its detented closed position against the bias of the spring which urges the door to that closed position.

In a preferred form of junction box 35, the rear end of sleeve 20' is specially defined in combination with the geometry of the electrical power connection moiety to enable base 36 and that moiety to be readily assembled and secured together. That arrangement is depicted in FIGS. 10 and 23. As noted above the preferred electrical power connection moiety, as such, is in the form of a three terminal (68) grounded male plug 67 (see FIG. 23) having a round ground pin and two blade terminals. Those three terminals are disposed in a recess formed by the forwardly opening front end of sleeve 20'; that recess forms a socket for receipt of a round female connector assembly of an electrical extension cord of conventional design and geometry. The terminals of the plug are carried in a plug body which preferably is molded around the terminals and around the connections to those terminals of the conductors of a three-wire electrical cable 69 of selected length. Cable 69 can extend from the plug parallel to the terminals, but it is preferred that the cable extend from the plug in a direction which is perpendicular to the terminals.

As shown in FIG. 10, the rear end of sleeve 20' can define a pair of planar lugs 70 which lie in the plane of sleeve rear opening 22, which are diametrically opposed to each other on opposite sides of the sleeve axis, and which each preferably subtend an arc of less than 90° about the sleeve axis. Plug 67 (see FIG. 23) defines a circumferential groove 71 which has a width corresponding to the thickness of each lug 70. Between that groove and terminals 68, the plug body defines a circumferential flange 72. That flange is notched (relieved), as at 73, to the base of groove 71 at two locations which are diametrically opposite to each other. Each notch has a profile which corresponds to the profile of lugs 70 when the plug is viewed axially and the lugs are viewed along the axis of sleeve 20'. Plug 67 can be assembled to base 36 from the rear of the base by mating lugs 70 in plug notches 73 (terminals 68 then are within sleeve 20'), moving the plug axially toward the base so that the lugs are in plug groove 71, and then turning the plug about 90°. The plug body can be made of an elastomeric material which deforms around lugs 70 and urges the plug into snug contact with the base about opening 22.

Preferably the plug 67 defines a pair of radial projections 75 on its exterior in a selected angular relation to notches 73 and in close proximity to each other to define a narrow gap between them. When the plug is properly engaged with base 36, that gap registers with a rearwardly open hole 76 in an exterior boss 77 on sleeve 20' (see FIG. 10). A keying or locking screw can be engaged through that gap into hole 76 to prevent the plug from turning in the sleeve.

Circles 80 in FIGS. 10 and 12 represent sockets of rearwardly extending threaded mounting studs or holes for mounting bolts for the junction box.

In view of the foregoing description and the accompanying illustrations, it will be seen that when door 38 is in its fully closed relation to base 36 of junction box 35 as mounted via gasket to the exterior surface of a truck tractor, the box is essentially weather tight.

Figure 16:
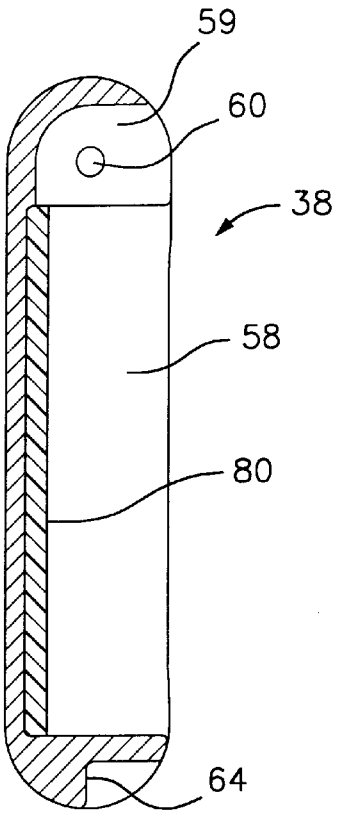
FIG. 16 is a cross-sectional elevation view taken along line 16—16 in FIG. 15.
Figure 15:
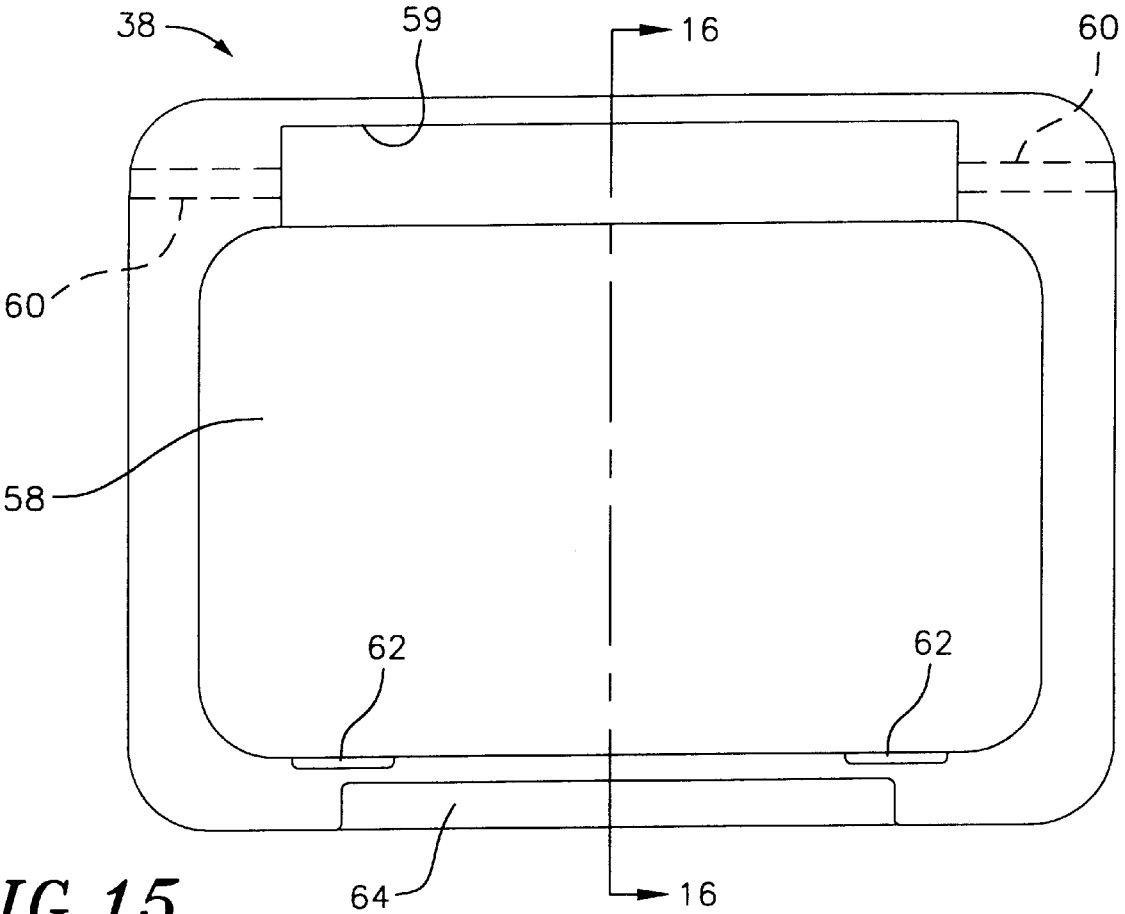
FIG. 15 is a rear elevation view of that door.
Figure 20:
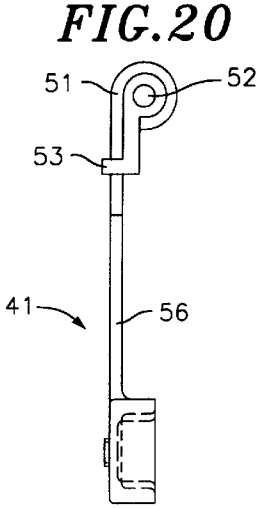
FIG. 20 is a side elevation view of the cable connection cover shown in FIG. 19.
Figure 19:
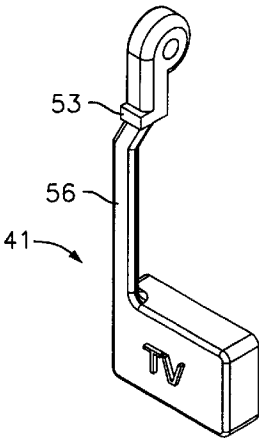
FIG. 19 is a front perspective view of a cover for the TV or coaxial cable connection within the junction box shown in FIGS. 9–12.
Figure 18:
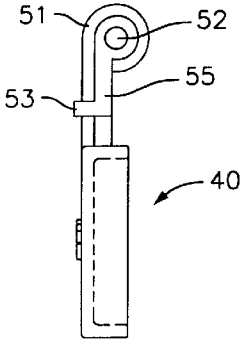
FIG. 18 is a side elevation view of the telephone jack cover shown in FIG. 17.
Figure 17:
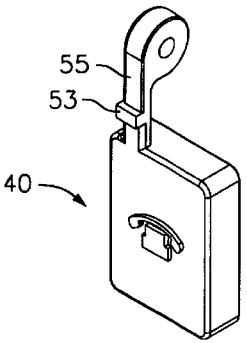
FIG. 17 is a front perspective view of a cover for the telephone jack connection within the junction box shown in FIGS. 9–12.
Figure 22:
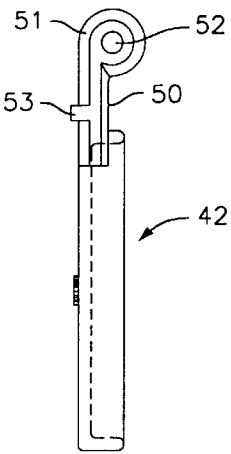
FIG. 22 is a side elevation view of the power connection cover shown in FIG. 21.
Figure 21:
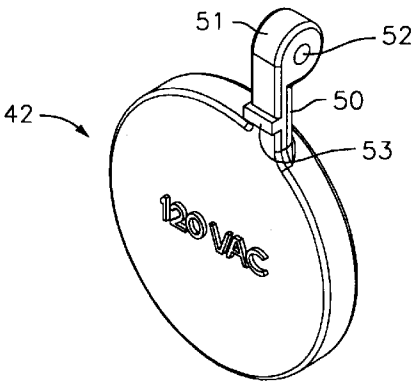
FIG. 21 is a front perspective view of a cover for the electrical power connection within the junction box shown in FIGS. 9–12.

Junction box 35 provides a weathertight double seal for its connection moieties when the tractor is on the road and during times when none of those moieties are in use. That double seal is provided by door 38's closure of the space within frame 17, preferably by a gasket as shown in FIG. 16, and by the seals provided by the cooperation of each secondary or inner cover 40, 41 and 42 with its respective connection moiety or the mounting for that moiety. During times when door 38 is open due to the use of some but not all of the connection moieties while the tractor is parked, those moieties not in use continue to be protected from the weather by their inner covers.

The concepts, features and principles of this invention can be extended or adapted to additional electrical functional connections if desired, or to fiber-optic connections. Such connections can be used to transmit truck performance data, or data pertinent to cargo being transported by the truck, from the truck to remote data gathering and processing sites. That data may be acquired and stored for transmission by equipment incorporated into the truck tractor and/or its trailer(s). Also, the connection assemblies described above can be used in the cabs of single chassis trucks, and in house trailers, motor homes, and recreational vehicles.

What is claimed is:

1. A power and communications connection assembly for vehicles including truck tractors, motor homes and recreational vehicles, the assembly being comprised by a base adapted to be mounted to a vehicle exterior surface to present a front face of the base to the exterior of the vehicle and to present a rear face of the base inwardly of that surface, a plurality of openings through the base inwardly of a perimeter of the base at least one of which openings as defined in the base is configured differently from at least one of the other openings of the plurality, each opening being defined and configured for receiving and mounting a respective selected connection moiety for cooperation of that connection moiety adjacent the base front face with a complementary connection moiety, the connection moieties mountable in the openings being selected from the group comprised of electrical power connectors, telephone circuit connectors, coaxial cable connectors, fiber optic cable connectors, and connectors on cords from infrared wireless communications receivers, and a cover hinged to the base and biased into a closure relation to the base in which the cover protects connection moieties mounted in the base openings.

2. Apparatus according to claim 1 in which the cover substantially releasably seals to the base perimeter in its closure relation to the base.

3. Apparatus according to claim 1 in which at least one of the openings in the base is defined and configured for mounting an electrical power connection moiety, at least one of the openings is defined and configured for mounting a telephone circuit connection moiety, and at least one opening is defined and configured for mounting a coaxial cable connection moiety.

4. A power and communications connection assembly for vehicles including truck tractors, motor homes and recreational vehicles, the assembly being comprised by a base adapted to be mounted to a vehicle exterior surface to present a front face of the base to the exterior of the vehicle and to present a rear face of the base inwardly of that surface, a plurality of openings through the base inwardly of a perimeter of the base, each opening being defined and configured for receiving and mounting a respective selected connection moiety for cooperation of that connection moiety adjacent the base front face with a complementary connection moiety, the connection moieties mountable in the openings being selected from the group comprised of electrical power connectors, telephone circuit connectors, coaxial cable connectors, fiber optic cable connectors, and connectors on cords from infrared wireless communications receivers, a primary cover hinged to the base and biased into a closure relation to the base in which the primary cover protects connection moieties mounted in the base openings, and a number of secondary covers individually engageable with features of at least one of either or both of a) a respective opening of the plurality of openings or b) a connection moiety mounted in a respective opening of the plurality of openings, the secondary covers in their engaged conditions being covered by the primary cover when the latter cover is in its closure relation to the base.

5. Apparatus according to claim 4 in which the secondary covers are hinged to the base.

6. Apparatus according to claim 5 in which the secondary covers are hinged to the base for movement about a common hinge axis.

7. Apparatus according to claim 6 in which the common hinge axis of the secondary covers also is common to the hinge axis about the primary cover is moveable relative to the base.

8. Apparatus according to claim 7 in which the base defines a frame substantially continuously around the base front face area in which the openings are defined, the common hinge axis is outside the frame, and features of the secondary covers in the engaged conditions thereof lie in and effectively close gaps in the frame.

9. Apparatus according to claim 8 in which said secondary cover features are defined by a material which is deformable as compared to the base material.

10. Apparatus according to claim 4 in which at least the portions of the secondary covers which are engageable with respective opening features or with a connection moiety are deformable.

11. A power and communications connection assembly for vehicles including truck tractors, motor homes and recreational vehicles, the assembly being comprised by a base adapted to be mounted to a vehicle exterior surface to present a front face of the base to the exterior of the vehicle and to present a rear face of the base inwardly of that surface, a plurality of openings through the base inwardly of a perimeter of the base, each opening being defined and configured for receiving and mounting a respective selected connection moiety for cooperation of that connection moiety adjacent the base front face with a complementary connection moiety, the connection moieties mountable in the openings being selected from the group comprised of electrical power connectors, telephone circuit connectors, coaxial cable connectors, fiber optic cable connectors, and connectors on cords from infrared wireless communications receivers, a cover hinged to the base and biased into a closure relation to the base in which the cover protects connection moieties mounted in the base openings, and at least one set of detent features cooperable between the base and the cover when the cover is in closure relation to the base.

12. A power and communications connection assembly for vehicles including truck tractors, motor homes and recreational vehicles, the assembly being comprised by a base adapted to be mounted to a vehicle exterior surface to present a front face of the base to the exterior of the vehicle and to present a rear face of the base inwardly of that surface, a plurality of openings through the base inwardly of a perimeter of the base at least one of which openings is configured differently from at least one of the other openings of said plurality, an electric power connection moiety mounted in one of the openings for cooperation adjacent the base front face with a complementary electric power connection moiety, communication connection moieties similarly mounted in each remaining opening through the base, the communication connection moieties being selected from the group comprised of telephone jacks, coaxial cable connectors, fiber optic cable connectors, and connectors on cords from infrared wireless communications receivers, and a cover hinged to the base and biased relative to the base into a closure relation to the base in which the cover provides protection of the connection moieties mounted in the base openings.

* * * * *